US008657911B2

(12) United States Patent
Kurita et al.

(10) Patent No.: US 8,657,911 B2
(45) Date of Patent: Feb. 25, 2014

(54) MOISTURE SEPARATOR/HEATER

(75) Inventors: Sumio Kurita, Yokohama (JP); Koichi Yoshimura, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 160 days.

(21) Appl. No.: 13/147,324

(22) PCT Filed: Feb. 2, 2010

(86) PCT No.: PCT/JP2010/051416

§ 371 (c)(1),
(2), (4) Date: Aug. 1, 2011

(87) PCT Pub. No.: WO2010/090180

PCT Pub. Date: Aug. 12, 2010

(65) Prior Publication Data

US 2011/0290459 A1 Dec. 1, 2011

(30) Foreign Application Priority Data

Feb. 3, 2009 (JP) ..... 2009-022619

(51) Int. Cl.
*B01D 45/00* (2006.01)

(52) U.S. Cl.
USPC ..... 55/434.2; 55/423; 55/426; 55/424; 55/392; 55/434.3; 55/462; 55/465; 96/113; 96/126; 96/174; 96/189

(58) Field of Classification Search
USPC ..... 55/423, 426, 424, 392, 394, 434.3, 55/434.2, 462, 465; 96/113, 126, 174, 189
See application file for complete search history.

(56) References Cited

FOREIGN PATENT DOCUMENTS

| | | |
|---|---|---|
| JP | 62 245008 | 10/1987 |
| JP | 4 252812 | 9/1992 |
| JP | 2000 310401 | 11/2000 |

OTHER PUBLICATIONS

English Translation of the International Preliminary Report on Patentability issued Aug. 9, 2011, in Patent Application No. PCT/JP2010/051416.
English Translation of the Written Opinion of the International Searching Authority issued May 11, 2010, in Patent Application No. PCT/JP2010/051416.
International Search Report issued May 11, 2010 in PCT/JP10/51416 filed Feb. 2, 2010.

*Primary Examiner* — Dung H Bui
(74) *Attorney, Agent, or Firm* — Oblon, Spivak, McClelland, Maier & Neustadt, L.L.P.

(57) ABSTRACT

A moisture separator/heater, including a cylindrical main shell, a moisture separator that removes moisture in steam to be heated that flows in through the bottom of the main shell, a heater disposed above the moisture separator in the main shell, and restricting members disposed in a heating space to sandwich a tube bundle side plate with an outer rail to restrict rounded-back deformation thereof and satisfy an expression of $0.2 \leq L1/L$ and $L2/L \leq 0.4$, L represents total length of a straight tube portion, L1 represents distance from one of the pad members closest to a steam heating header to an end of the straight tube portion on the side where the steam heating header is present, and L2 represents distance from one of the pad members closest to a curved tube portion to an end of the straight tube portion on the side where the curved tube portion is present.

9 Claims, 9 Drawing Sheets

MOISTURE SEPARATOR/HEATER

TECHNICAL FIELD

The present invention relates to a moisture separator/heater that removes moisture from highly moist steam and heats the steam from which the moisture has been removed to thereby produce superheated steam.

BACKGROUND ART

In a steam turbine in a nuclear power plant, for example, a moisture separator/heater is provided between a high-pressure turbine and a low-pressure turbine in the nuclear power plant. The moisture separator/heater has a function of removing moisture contained in the exhaust (steam) from the high-pressure turbine and heating the steam from which the moisture has been removed to produce superheated steam. The moisture separator/heater includes a horizontally-oriented cylindrical main shell with both ends sealed with end plates, a moisture separator that separates moisture in steam to be heated that flows into the main shell, and a heater that heats the steam to be heated to produce superheated steam.

In a large-capacity nuclear power plant, either of the following moisture separator/heaters has been used: a simplex moisture separator/heater in which a tube bundle that works as a heater extends from one end plate of a main shell in each single moisture separator/heater, and a duplex moisture separator/heater in which a tube bundle that works as a heater extends from both end plates of a main shell in each single moisture separator/heater.

The structure of each of the moisture separator/heaters of related art will be described with reference to the drawings.

FIG. 9 is a schematic view showing a simplex moisture separator/heater of related art. FIG. 10 is a schematic view showing a duplex moisture separator/heater of related art. FIG. 11 is a transverse cross-sectional view showing a moisture separator/heater of related art.

First, as shown in FIG. 9, a simplex moisture separator/heater 50 of related art includes a horizontally-oriented (the axial direction corresponds to the horizontal direction) cylindrical main shell 2, a moisture separator 3, and a heater 4, which are accommodated in the main shell 2.

The interior of the main shell 2 is partitioned by a first partition plate 6 and a second partition plate 7. A header space 10 is created between the first partition plate 6 and an end plate 8. A heating space 11 is created between the first partition plate 6 and the second partition plate 7. Low-temperature steam inlets 13 that communicate with the heating space 11 are provided at the bottom of the main shell 2. High-temperature steam outlets 14 that communicate with the heating space 11 are provided at the top of the main shell 2. Each of the first partition plate 6 and the second partition plate 7 has an opening (not shown) through which the heater 4 is inserted.

The moisture separator 3 is disposed in a lower portion of the heating space 11. The moisture separator 3 separates moisture in steam to be heated that flows in through the low-temperature steam inlets 13, which are provided at the bottom of the main shell 2.

The heater 4 is formed of a first-stage heater 4*a* heated by high-pressure turbine bleed air and a second-stage heater 4*b* heated by primary steam delivered from a reactor. The first-stage heater 4*a* and the second-stage heater 4*b* are composed of respective steam heating headers 16*a* and 16*b* and a plurality of respective U-shaped heat-transfer tubes (or pipes) 17*a* and 17*b*. The steam heating headers 16*a* and 16*b* are disposed in the header space 10.

The U-shaped heat-transfer tubes 17*a* and 17*b* have straight tube (pipe) portions 18*a* and 18*b*, which are disposed in the heating space 11 and heat the steam to be heated. The U-shaped heat-transfer tubes 17*a* and 17*b* also have curved tube (pipe) portions 19*a* and 19*b*, which are disposed in a space 22 (outside the heating space 11) created between the second partition plate 7 and an end plate 21. The first-stage heater 4*a* and the second-stage heater 4*b* are connected to heating steam pipes 24*a* and 24*b*, vent pipes 25*a* and 25*b*, and drain pipes 26*a* and 26*b*, respectively, which pass through the end plate 8 of the main shell 2 in order to communicate with components external to the moisture separator/heater 50.

Next, as shown in FIG. 10, a duplex moisture separator/heater 60 of related art includes a horizontally-oriented cylindrical main shell 61, moisture separators 3, and heaters 4, which are accommodated in the main shell 61. 10. The duplex moisture separator/heater 60 of related art is configured symmetrically with respect to an imaginary central plane A-A at the center of the main shell 61 in the longitudinal direction.

The interior of the main shell 61 is partitioned by the first partition plate 6 and the second partition plate 7. A header space 10 is created between each of the first partition plates 6 and an end plate 8. A heating space 11 is created between each the first partition plates 6 and the corresponding second partition plate 7. A central space 62 (outside the heating spaces 11) is created between the second partition plates 7, which face each other. Low-temperature steam inlets 13 that communicate with the heating spaces 11 are provided at the bottom of the main shell 61. High-temperature steam outlets 14 that communicate with the heating spaces 11 are provided at the top of the main shell 61. Each of the first and second partition plates 6 and 7 has an opening (not shown) through which the heaters 4 are inserted.

Each of the moisture separators 3 is disposed at a bottom of the corresponding heating space 11. The moisture separators 3 separate moisture in steam to be heated that flows through the low-temperature steam inlets 13, which are provided at the bottom of the main shell 2.

Each of the heaters 4 is composed of a first-stage heater 4*a* heated by high-pressure turbine bleed air and a second-stage heater 4*b* using primary steam delivered from a reactor. The first-stage heater 4*a* and the second-stage heater 4*b* are composed of respective steam heating headers 16*a* and 16*b* and a plurality of respective U-shaped heat-transfer tubes 17*a* and 17*b*. The steam heating headers 16*a* and 16*b* are disposed in each of the header spaces 10. The U-shaped heat-transfer tubes 17*a* and 17*b* have straight tube portions 18*a* and 18*b*, which are disposed in each of the heating spaces 11 and heat the steam to be heated. The U-shaped heat-transfer tubes 17*a* and 17*b* also have curved tube portions 19*a* and 19*b*, which are disposed in the central space 62. Each set of the first-stage heater 4*a* and the second-stage heater 4*b* are connected to heating steam pipes 24*a* and 24*b*, vent pipes 25*a* and 25*b*, and drain pipes 26*a* and 26*b*, respectively, which pass through the corresponding end plate 8 of the main shell 61 in order to communicate with components external to the moisture separator/heater 60.

As shown in FIG. 11, the moisture separator/heater 50 (60) of related art shown in FIG. 9 (10) has two moisture separators 3 disposed at a bottom of the main shell 2 (61) in a manner to be inclined to and face each other, the first-stage heater(s) 4*a* disposed above the moisture separators 3, and the second-stage heater(s) 4*b* disposed above the first-stage heater(s) 4*a*. A drain channel 29 sandwiched between a bottom plate 27 and a ceiling plate 28 is formed between the two moisture separators 3.

Channel partition plates 31, 32*a*, and 32*b* are disposed in the main shell 2 (61) in this order in the direction from the low-temperature steam inlets 13 provided at the bottom of the main shell to the high-temperature steam outlets 14 provided at the top of the main shell. The structure described above forms a channel through which the steam to be heated is sequentially guided through the moisture separators 3, the first-stage heater 4*a*, and the second-stage heater 4*b*. The drain channel 29 is isolated from the channel through which the steam to be heated flows. The spaces surrounded by the channel partition plates 31 and the channel partition plates 32*a* communicate with the downstream side of the moisture separators 3. The spaces surrounded by the channel partition plates 32*s* and the channel partition plates 32*b* communicate with the downstream side of the first-stage heater 4*a*.

The U-shaped heat-transfer tubes 17*a* and 17*b* are held by not only a plurality of heat-transfer tube supporting plates 33*a* and 33*b* disposed at fixed intervals along the longitudinal direction of the U-shaped heat-transfer tubes but also tube bundle side plates 34*a* and 34*b* that form the channel through which the steam to be heated flows. The tube bundle side plates 34*a* and 34*b* have inner rails 36*a* and 36*b* attached thereto. On the other hand, the channel partition plates 32*a* and 32*b* have outer rails 37*a* and 37*b* attached thereto. The tube bundle side plates 34*a* and 34*b* are held by the inner rails 36*a* and 36*b*, which are placed on the outer rails 37*a* and 37*b*. The inner rails 36*a* and 36*b* are configured to be slidable on the outer rails 37*a* and 37*b* along the longitudinal direction of the U-shaped heat-transfer tubes 17*a* and 17*b*. The structure, in which the inner rails 36*a* and 36*b* slide on the outer rails 37*a* and 37*b*, allows thermal expansion of the U-shaped heat-transfer tubes 17*a* and 17*b* caused when high-temperature heated steam flows therein.

The thus configured moisture separator/heater 50 (60) of related art guides the steam to be heated that flows through the low-temperature steam inlets 13 to the moisture separators 3 and the heater 4 in this order in the heating space 11 and discharges superheated steam produced in moisture separation and heating processes through the high-temperature steam outlets 14 to a low-pressure turbine.

Inside the moisture separator/heater 50 (60) of related art, the steam to be heated flows as low-temperature saturated steam into the bottom of the main shell 2 (61) and then flows as superheated steam out of the top of the main shell 2 (61). A temperature gradient is therefore created in each internal structure in the main shell 2 (61), such as the moisture separators 3 and the heater 4, that is, the temperature increases from a lower portion to an upper portion of each component. As a result, there causes a phenomenon in which the main shell 2 (61) is deformed to provide rounded-back shape in which a central portion thereof rises higher than both ends thereof.

Further, in the moisture separator/heater 50 (60) of related art, there exist steam flows (not shown) through leak paths (short paths) that hamper normal heat exchange as well as the steam flows indicated by the broken arrows A in FIG. 11.

In the operational state described above, the inner rails 36*a* and 36*b* attached to the tube bundle side plates 34*a* and 34*b* tend to be hotter than the outer rails 37*a* and 37*b* attached to the channel partition plates 32*a* and 32*b*. Since such temperature difference causes a difference in the amount of thermal deformation between the inner and outer rails, a gap is created between each inner rail and the corresponding outer rail, which should be in contact with each other, in the vicinity of central portions of the rails, resulting in steam leakage indicated by the broken arrows B in FIG. 11.

The presence of the leak paths through which the heated steam flows causes decrease in performance of the moisture separator/heater. To address the problem, there has been a known moisture separator/heater including pad members that along with the outer rails 37*a* and 37*b* sandwich the inner rails 36*a* and 36*b* to prevent a gap from being created between each inner rail and the corresponding outer rail, which should be in contact with each other (for example, refer to Japanese Patent Laid-Open No. 2000-310401: Patent Document 1).

In a moisture separator/heater of related art, the length of the heat-transfer tubes used as the heater has been limited to about 10 m in term of manufacturing technology limitation. It is therefore difficult for a simplex moisture separator/heater of related art to exchange a greater amount of heat than a duplex moisture separator/heater of related art. Because of this reason, there have been few simplex moisture separator/heaters that exchange a comparable amount of heat with a duplex moisture separator/heater of related art. Further, since it is necessary to install many simplex moisture separator/heaters of related art to provide the same amount of heat exchange as that of a duplex moisture separator/heater of related art, a duplex moisture separator/heater, which excels in space-to-heat exchange performance, has been recently frequently used.

Recent technological advance, however, has enabled a much longer heat-transfer tube as long as nearly 20 meter to be manufactured, which allows a simplex moisture separator/heater that exchanges a comparable amount of heat with a duplex moisture separator/heater of related art to be manufactured. A simplex moisture separator/heater having such long heat-transfer tubes can solve the problem of the number of moisture separator/heaters of related art to be installed described above and provide the highest space-to-heat exchange performance.

Use of such long heat-transfer tubes, however, provides a new problem.

A moisture separator/heater may cause rounded-back deformation in which a central portion of the main shell rises higher than both ends thereof when a temperature gradient is created inside the main shell, as described above. In the operational state in which the deformation occurs, the inner rails attached to the tube bundle side plates tend to be hotter than the outer rails attached to the channel partition plates.

Since the temperature difference causes a difference in the amount of thermal deformation between the inner and outer rails, a gap is created between each inner rail and the corresponding outer rail, which should be in contact with each other, in the vicinity of central portions of the rails. Further, when the steam to be heated (cycle steam) flows at high speed, a lifting force of the steam to be heated becomes greater than the self-weight of the heater. In this case, the U-shaped heat-transfer tubes are lifted, and the gap at the contact surface of the inner and outer rails further increases.

That is, a heater using very long heat-transfer tubes causes a greater gap than a heater in a moisture separator/heater of related art because the lifting force of the steam to be heated lifts the U-shaped heat-transfer tubes.

Since the increase in the amount of gap causes decrease in performance of a moisture separator/heater, preventive measures are required.

DISCLOSURE OF THE INVENTION

In view of the related art described above, an object of the present invention is to provide a moisture separator/heater in which the leak paths between the inner and outer rails can be made sufficiently narrow irrespective of the length of the heat-transfer tubes.

To achieve the object, the present invention provides a moisture separator/heater comprising: a horizontally-oriented cylindrical main shell with both ends sealed with end plates; a first partition plate disposed in the main shell on a side where one of the end plates is present and creating a header space between the first partition plate and the end plate; a second partition plate disposed in the main shell and creating a heating space between the second partition plate and the header-side partition plate; a moisture separator disposed in a lower portion of the heating space and removing moisture in steam to be heated that flows in through a bottom of the main shell; a heater disposed above the moisture separator in the main shell; a channel partition plate that partitions the interior of the heating space in such a way that the steam to be heated having flowed in through a low-temperature steam inlet provided at the bottom of the main shell flows into the moisture separator, passes therethrough, and flows into the heater; a plurality of heat-transfer supporting plates disposed in the heating space at appropriate intervals along a longitudinal direction of the heater; a tube bundle side plate placed on the channel partition plate and extending along the longitudinal direction of the heater, the tube bundle side plates supporting the heater; and a plurality of restricting members disposed in the heating space.

The heater includes a heater header disposed in the header space and a U-shaped heat-transfer tube connected to the heater header. The U-shaped heat-transfer tube is formed of a straight tube portion disposed in the heating space and heating the steam to be heated that has passed through the moisture separator and a curved tube portion disposed outside the heating space. The tube bundle side plate has an inner rail attached thereto. The channel partition plate has an outer rail on which the inner rail is placed thereon in a slidable manner along the longitudinal direction of the U-shaped heat-transfer tube. The restricting members along with the outer rail sandwich the tube bundle side plate to restrict rounded-back deformation thereof and are so disposed that the following expression is satisfied:

$$0.2 \leq L1/L,\ L2/L \leq 0.4$$

where L represents the total length of the straight tube portion, L1 represents the distance from one of the restricting members that is closest to the heater header to an end of the straight tube portion on the side where the heater header is present, and L2 represents the distance from one of the restricting members that is closest to the curved tube portion to an end of the straight tube portion on the side where the curved tube portion is present.

In a preferred embodiment of the moisture separator/heater having the feature described above, the restricting members may be pad members that are attached to the channel partition plate and along with the outer rail sandwich the inner rail.

Further, the restricting members may be pad members that are attached to the channel partition plate, extend to an upper portion of the tube bundle side plate, and along with the outer rail sandwich the tube bundle side plate and the inner rail.

In this case, the upper portion of the tube bundle side plate and the restricting members are desirably disposed with a gap therebetween.

Further, the restricting members are desirably the heat-transfer supporting plates configured so that the heat-transfer supporting plates along with the outer rail sandwich the inner rail. In this case, the inner rail and the restricting members are desirably disposed with a gap therebetween.

Moreover, the restricting members may be the heat-transfer supporting plates configured so that they extend to an upper portion of the tube bundle side plate and along with the outer rail sandwich the tube bundle side plate and the inner rail.

The present invention proposes a moisture separator/heater in which a leak path between an inner rail and an outer rail can be made sufficiently narrow irrespective of the length of a heat-transfer tube.

Other features and characteristics of the present invention will be further clarified from the following description made with reference to the accompanying drawings.

MODES FOR EMBODYING THE INVENTION

Embodiments of a moisture separator/heater according to the present invention will be described hereunder with reference to the accompanying drawings.

In the following description, it should be understood that the terms "upper," "lower," "right," "left," and like terms showing direction or like are used only in the context of illustration or actual installation of the moisture separator/heater.

[First Embodiment]

A first embodiment of the moisture separator/heater according to the present invention will be described with reference to FIGS. 1 to 5.

Figure 1:
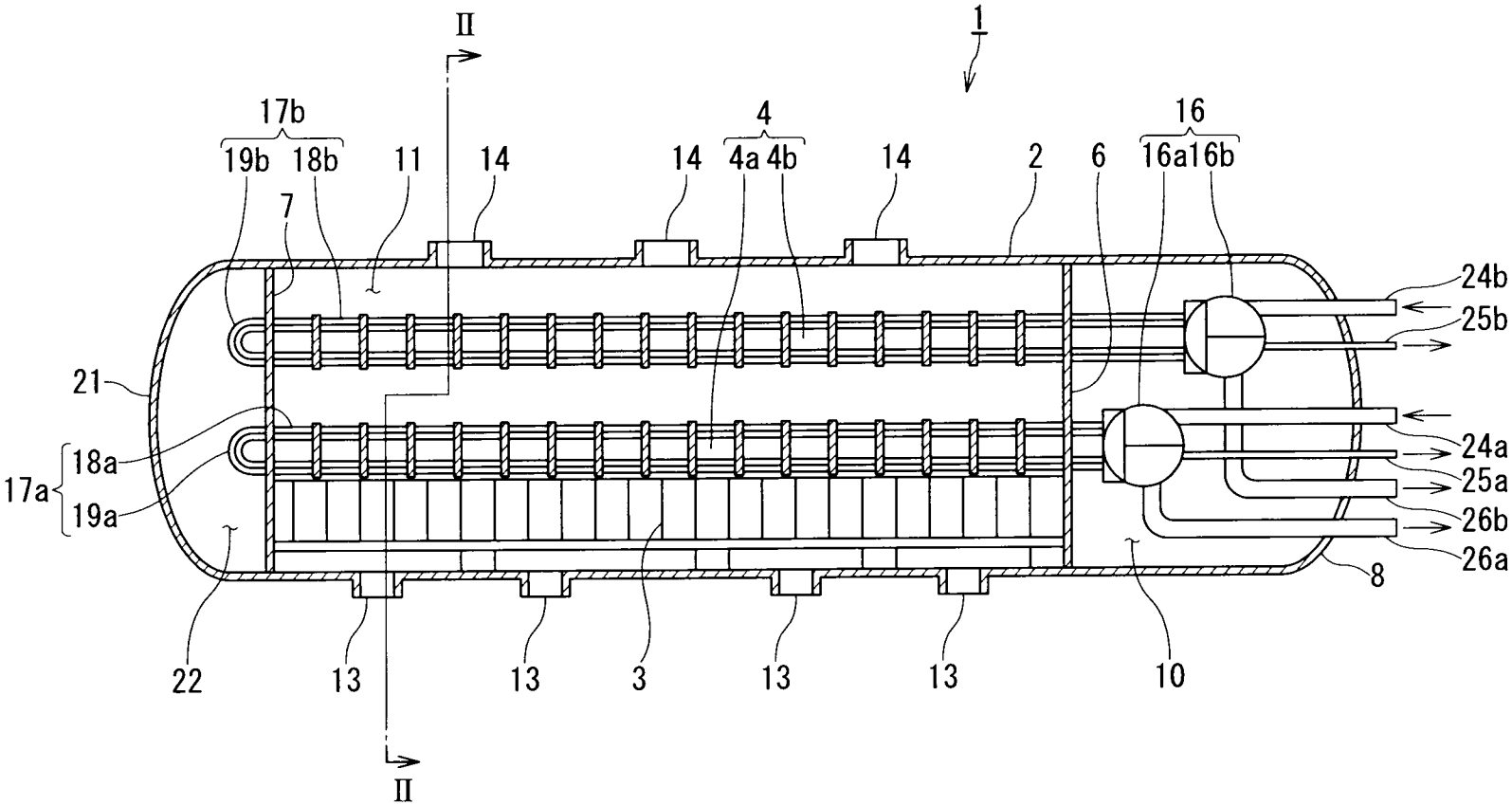
FIG. 1 is an axial (longitudinal) sectional view showing a schematic configuration of a moisture separator/heater according to a first embodiment of the present embodiment.

FIG. 1 is an axial (longitudinal) sectional view showing a schematic configuration of the moisture separator/heater according to the first embodiment of the present embodiment.

The moisture separator/heater 1 according to the present embodiment is a simplex moisture separator/heater, as shown in FIG. 1. The moisture separator/heater 1 includes a horizontally-oriented cylindrical main shell 2 (the longitudinal direction of the installed main shell 2 is oriented in the horizontal direction), a moisture separator 3, and a heater 4, which are accommodated in the main shell 2.

The interior of the main shell 2 is partitioned by a first partition plate 6 and a second partition plate 7. A header space 10 is created between the first partition plate 6 and an end plate 8. A heating space 11 is formed between the first partition plate 6 and the second partition plate 7. Low-temperature steam inlets 13 that communicate with the heating space 11 are provided at the bottom of the main shell 2. High-temperature steam outlets 14 that communicate with the heating space 11 are provided at the upper portion of the main shell 2. Each of the first partition plate 6 and the second 7 has an opening (not shown) through which the heater 4 is inserted.

The moisture separator 3 is disposed at the bottom of the heating space 11. The moisture separator 3 operates to separate moisture in steam to be heated that flows in through the low-temperature steam inlets 13, which are provided at the bottom of the main shell 2.

The heater 4 is formed of a first-stage heater 4*a* heated by high-pressure turbine bleed air and a second-stage heater 4*b* heated by primary steam delivered from a reactor. The first-stage heater 4*a* and the second-stage heater 4*b* are composed of respective steam heating headers 16*a* and 16*b* (heater headers) and a plurality of respective U-shaped heat-transfer tubes 17*a* and 17*b*. The steam heating headers 16*a* and 16*b* are disposed in the header space 10. The U-shaped heat-transfer tubes 17*a* and 17*b* have straight tube portions 18*a* and 18*b*, which are disposed in the heating space 11 and heat the steam to be heated. The U-shaped heat-transfer tubes 17*a* and 17*b* also have curved tube portions 19*a* and 19*b*, which are disposed in a space 22 (outside the heating space 11) formed between the second partition plate 7 and an end plate 21. The first-stage heater 4*a* and the second-stage heater 4*b* are connected to heating steam pipes 24*a* and 24*b*, vent pipes 25*a* and 25*b*, and drain pipes 26*a* and 26*b*, which pass through the end plate 8 of the main shell 2 in order to communicate with components external to the moisture separator/heater 1.

Figure 2:
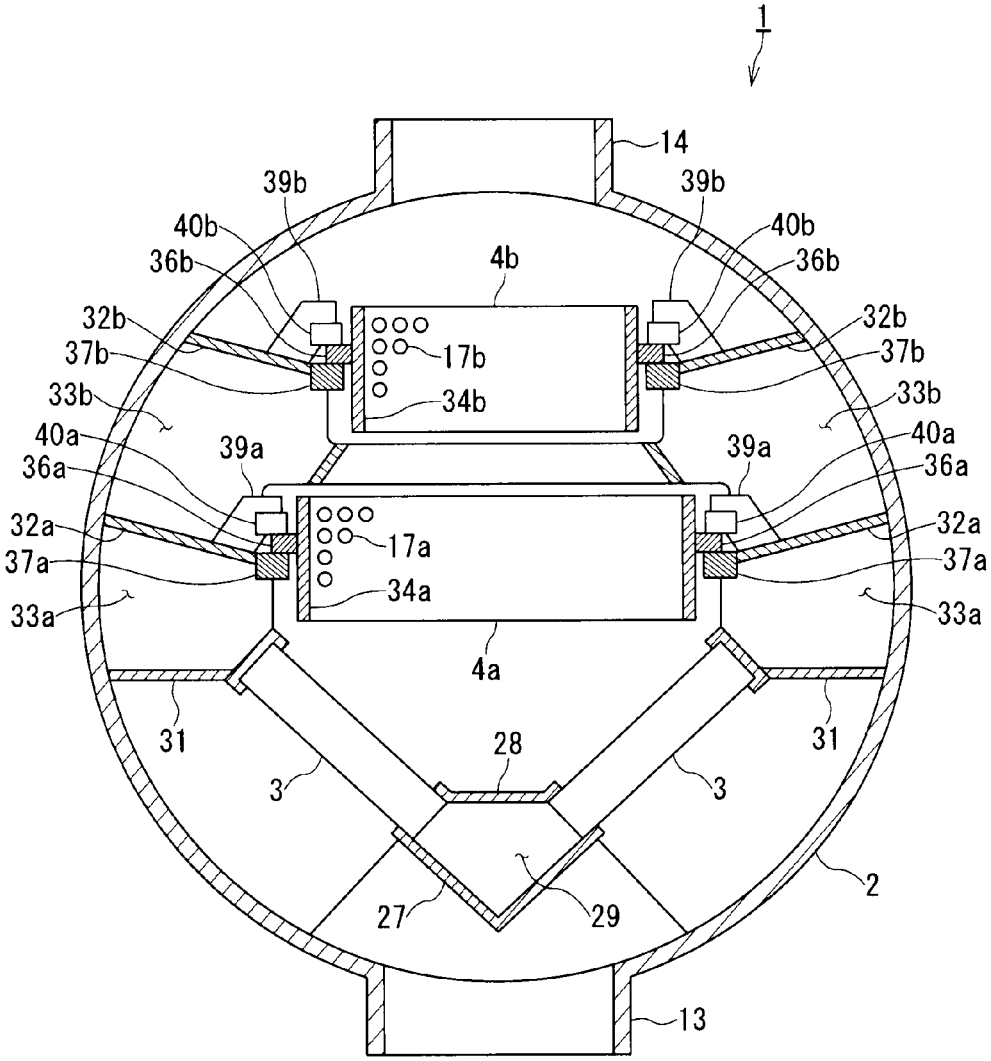
FIG. 2 is a cross-sectional view showing a schematic configuration of the moisture separator/heater according to the first embodiment of the present invention taken along the line II-II in FIG. 1.

FIG. 2 is a transverse sectional view showing a schematic configuration of the moisture separator/heater according to the first embodiment of the present invention.

As shown in FIG. 2, the moisture separator/heater 1 includes two moisture separators 3 disposed at the bottom of the main shell 2 so as to be inclined to and face each other, the first-stage heater 4*a* is disposed above the moisture separators 3, and the second-stage heater 4*b* is disposed above the first-stage heater 4*a*. A drain channel 29 sectioned from a bottom plate 27 and a ceiling plate 28 is formed between the two moisture separators 3.

Channel partition plates 31, 32*a* and 32*b* are disposed in the main shell 2 in this order in the direction from the low-temperature steam inlets 13 provided at the bottom of the main shell to the high-temperature steam outlets 14 provided at the top of the main shell. The structure described above forms a channel through which the steam to be heated is sequentially guided through the moisture separators 3, the first-stage heater 4*a* and the second-stage heater 4*b*. The drain channel 29 is isolated from the channel through which the steam to be heated flows. The spaces surrounded by the channel partition plates 31 and the channel partition plates 32*a* communicate with the downstream side of the moisture separators 3. The spaces surrounded by the channel partition plates 32*a* and the channel partition plates 32*b* communicate with the downstream side of the first-stage heater 4*a*.

The U-shaped heat-transfer tubes 17*a* and 17*b* are held by not only a plurality of heat-transfer tube supporting plates 33*a* and 33*b* disposed at fixed intervals along the longitudinal direction of the U-shaped heat-transfer tubes but also tube bundle side plates 34*a* and 34*b* that form the channel through which the steam to be heated flows. The tube bundle side plates 34*a* and 34*b* have inner rails 36*a* and 36*b* attached thereto. On the other hand, the channel partition plates 32*a* and 32*b* have outer rails 37*a* and 37*b* attached thereto. The tube bundle side plates 34*a* and 34*b* are held by the inner rails 36*a* and 36*b*, which are placed on the outer rails 37*a* and 37*b*. The inner rails 36*a* and 36*b* are configured to be slidable on the outer rails 37*a* and 37*b* along the longitudinal direction of the U-shaped heat-transfer tubes 17*a* and 17*b*. The structure, in which the inner rails 36*a* and 36*b* slide on the outer rails 37*a* and 37*b*, allows thermal expansion of the U-shaped heat-transfer tubes 17*a* and 17*b* caused when high-temperature heated steam flows therein.

The channel partition plates 32*a* and 32*b* have respective pad supporting pieces 39*a* and 39*b* attached thereto, and the pad supporting pieces 39*a* and 39*b* have respective pad members 40*a* and 40*b* (restricting members) attached thereto. The pad members 40*a*, 40*b* along with the respective outer rails 37*a*, 37*b* sandwich the tube bundle side plates 34*a* and 34*b* to thereby restrict the rounded-back deformation thereof.

Specifically, the pad members 40*a* and 40*b* along with the respective outer rails 37*a* and 37*b* sandwich the inner rails 36*a* and 36*b*, respectively. The pad members 40*a* and 40*b* are disposed at multiple locations along the longitudinal direction of the U-shaped heat-transfer tubes 17*a* and 17*b*. The pad members 40*a* and 40*b* may be disposed so as to be in contact with the respective inner rails 36*a* and 36*b* or gaps are provided between the pad members 40*a*, 40*b* and the respective inner rails 36*a*, 36*b*.

Providing gaps between the pad members 40*a*, 40*b* and the inner rails 36*a*, 36*b* not only makes the inner rails 36*a* and 36*b* more slidable but also allows the heater 4 to deform and prevents reaction forces from being induced in the pad members 40*a* and 40*b*.

Figure 3:
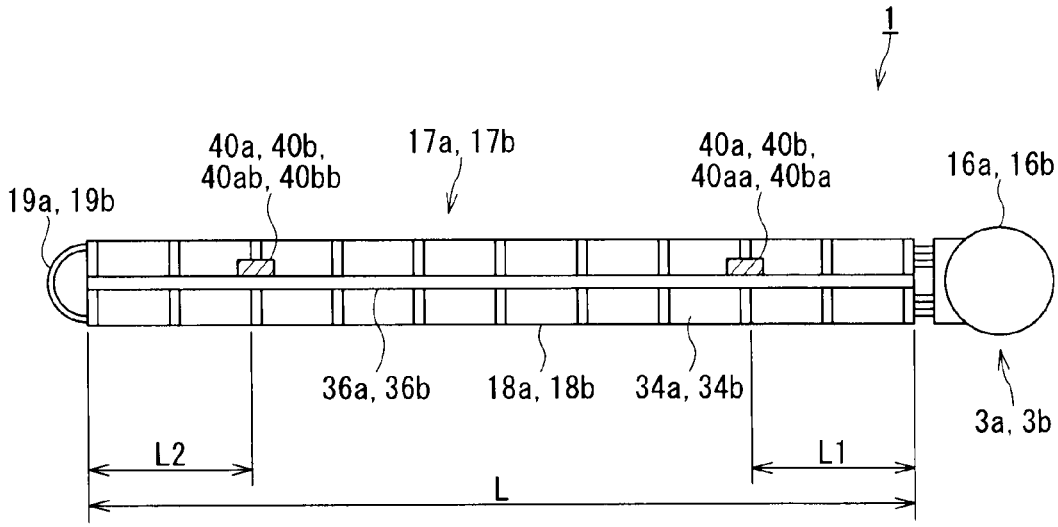
FIG. 3 is a schematic view showing the positional relationship between a heater and pad members in the moisture separator/heater according to the first embodiment of the present invention.

FIG. 3 is a schematic view showing the positional relationship between the heater and the pad members in the moisture separator/heater according to the first embodiment of the present invention.

Figure 4:
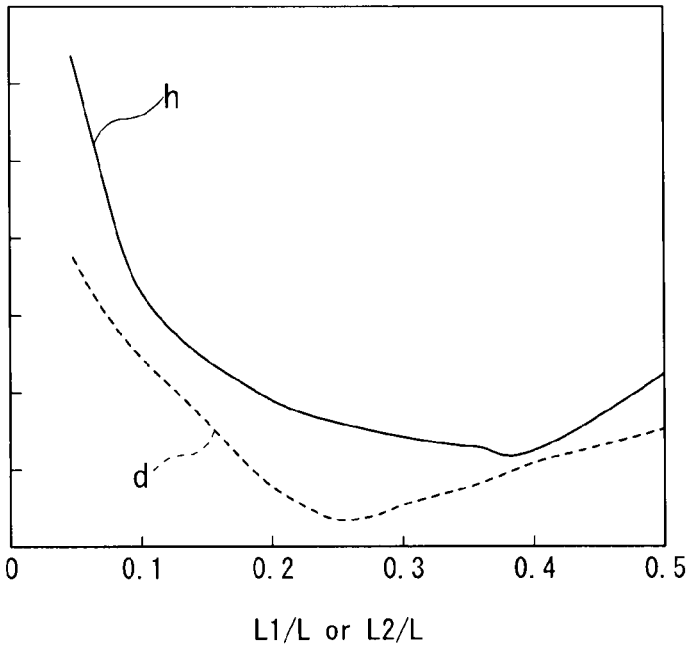
FIG. 4 shows the relationship between the positions where the pad members are disposed and a gap created between an inner rail and an outer rail in the moisture separator/heater according to the first embodiment of the present invention.

FIG. 4 shows the relationship between the positions where the pad members are disposed and the gap formed between each inner rail and the corresponding outer rail in the moisture separator/heater according to the first embodiment of the present invention.

As shown in FIGS. 3 and 4, among the plurality of pad members 40*a* and 40*b*, pad members 40*aa* and 40*ba* closest to the steam heating headers 16*a* and 16*b* and pad members 40*ab* and 40*bb* closest to the curved tube portions 19*a* and 19*b* are arranged so as to satisfy the following Expression 1.

$$0.2 \leq L1/L,\ L2/L \leq 0.4 \qquad \text{[Expression 1]}$$

In Expression 1, the letter L represents the total length of the straight tube portion 18*a* or 18*b*.

Further, L1 represents the distance from the pad member 40*aa* or 40*ba* to the end of the straight tube portion 18*a* or 18*b* on the side where the steam heating header 16*a* or 16*b* is present.

L2 represents the distance from the pad member 40*ab* or 40*bb* to the end of the straight tube portion 18*a* or 18*b* on the side where the curved tube portion 19*a* or 19*b* is present.

That is, as shown in FIG. 4, the gaps defined between the inner rails 36*a*, 36*b* and the outer rails 37*a*, 37*b* (broken line d in FIG. 4) can be minimized by disposing the pad members 40*aa* and 40*ba* and the pad members 40*ab* and 40*bb* in such a way that Expression 1 is satisfied. At the same time, reaction forces induced in the pad members 40*aa* and 40*ba* and the pad members 40*ab* and 40*bb* (solid line h in FIG. 4) can also be minimized as compared with a case where the pad members are disposed in other locations.

Figure 5:
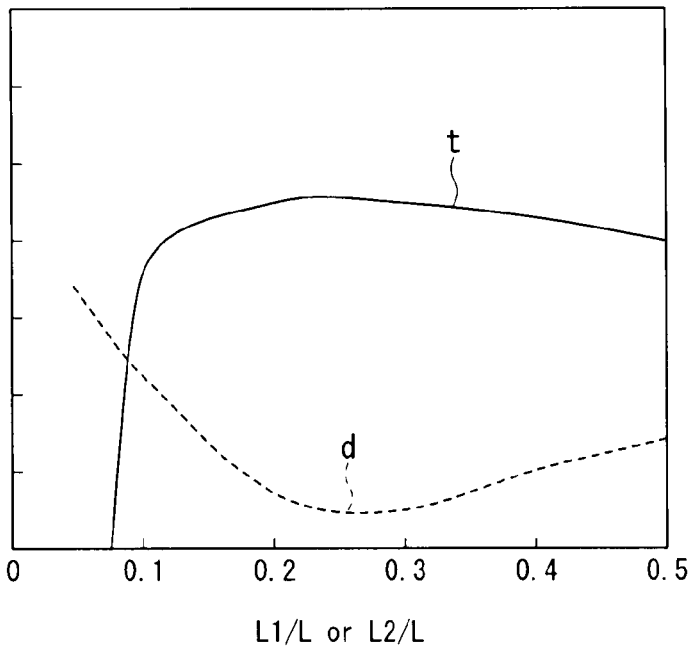
FIG. 5 shows the relationship between the positions where the pad members are disposed and the temperature of superheated steam at high-temperature steam outlets in the moisture separator/heater according to the first embodiment of the present invention.

FIG. 5 shows a graph representing the relationship between the positions where the pad members are disposed and the temperature of the superheated steam at the high-temperature steam outlets in the moisture separator/heater according to the first embodiment of the present invention.

As shown in FIG. 5, the gaps created between the inner rails 36*a*, 36*b* and the outer rails 37*a*, 37*b* (broken line d in FIG. 5) can be minimized by disposing the pad members 40*aa* and 40*ba* and the pad members 40*ab* and 40*bb* in such a way that Expression 1 is satisfied. Under the condition described above, the temperature of the superheated steam at the high-temperature steam outlets 14 (solid line t in FIG. 5) indicates that a sufficient amount of heat is exchanged between the heater 4 and the heated steam.

In the thus configured moisture separator/heater 1, the pad members 40*a* and 40*b* restrict deformation (torsion) of the inner rails 36*a* and 36*b*, which reduces the gaps created between the inner and outer rails when the heater 4 is lifted due to the difference in the amount of thermal deformation between the inner rails 36*a*, 36*b* and the outer rails 37*a*, 37*b* and a lifting force of the steam to be heated that flows through the main shell 2. In this configuration, disposing the pad members 40*a* and 40*b* according to the Expression 1 allows the gaps between the inner and outer rails and reaction forces induced in the pad members 40*a* and 40*b* to be minimized. Further, since the gaps between the inner and outer rails can be minimized, decrease in performance of the moisture separator/heater 1 resulting from leak paths between the inner and outer rails can be sufficiently reduced.

Therefore, in the moisture separator/heater 1 according to the present embodiment, the leak paths between the inner rails 36*a*, 36*b* and the outer rails 37*a*, 37*b* can be made sufficiently narrow irrespective of the length of the U-shaped heat-transfer tubes 17*a* and 17*b*.

In the above description, although the moisture separator/heater 1 according to the present embodiment was explained with reference to a simplex moisture separator/heater, it may also be configured as a duplex moisture separator/heater.

[Second Embodiment]

A second embodiment of the moisture separator/heater according to the present invention will be described with reference to FIG. 6.

Figure 6:
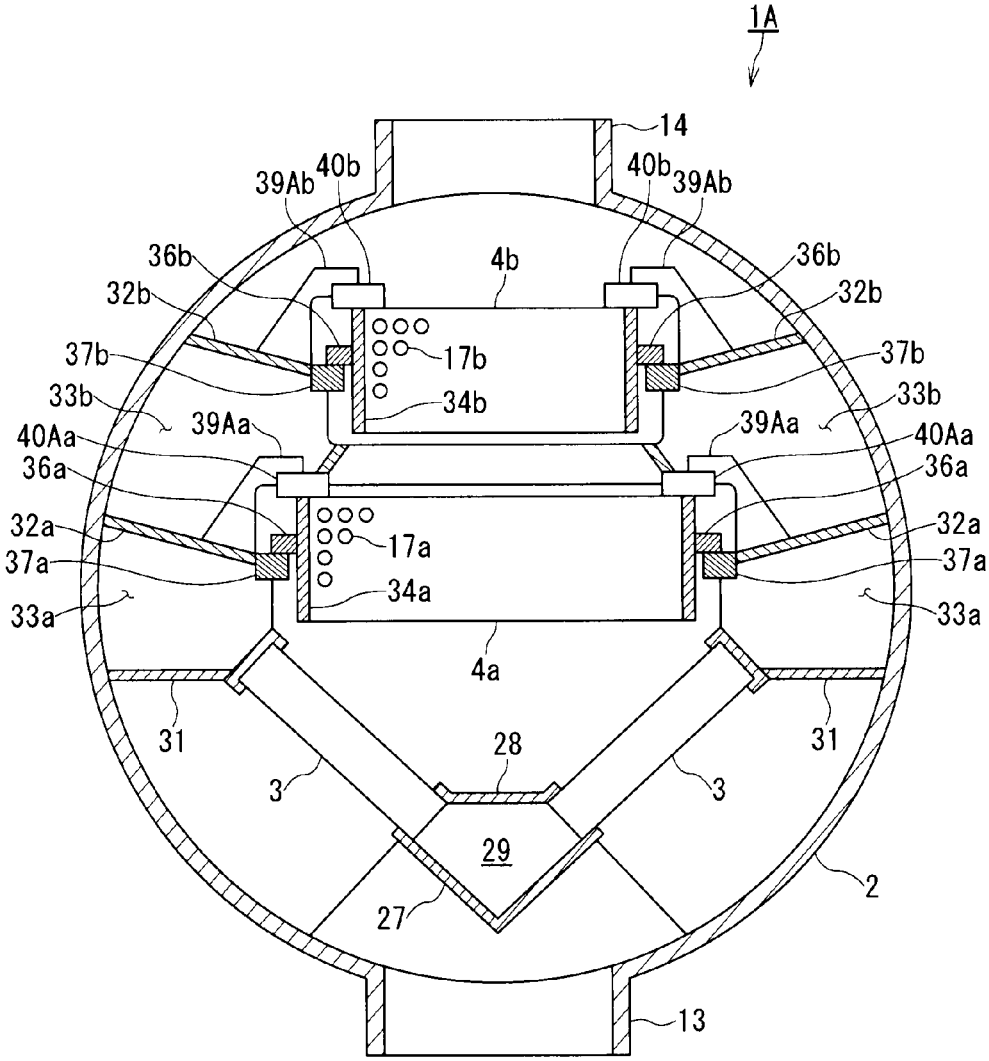
FIG. 6 is a transverse sectional view corresponding to FIG. 2 and showing a schematic configuration of a moisture separator/heater according to a second embodiment of the present invention.

FIG. 6 is a transverse sectional view showing a schematic configuration of the moisture separator/heater according to the second embodiment of the present invention.

In the present embodiment, the components common to those in the first embodiment are added with the same reference numerals, and duplicated description will be omitted.

As shown in FIG. 6, the channel partition plates 32*a* and 32*b* in a moisture separator/heater 1A according to the present embodiment are provided respectively with pad supporting pieces 39Aa and 39Ab attached thereto, and the pad supporting pieces 39Aa and 39Ab are also provided respectively with pad members 40Aa and 40Ab (restricting members) attached thereto.

The pad members 40Aa and 40Ab along with the respective outer rails 37*a* and 37*b* sandwich the respective tube bundle side plates 34*a* and 34*b* so as to restrict the rounded-back deformation thereof. Specifically, the pad members 40Aa and 40Ab, which extend from upper ends of the tube bundle side plates 34*a* and 34*b*, along with the outer rails 37*a* and 37*b* sandwich the upper half of the tube bundle side plates 34*a* and 34*b* and the inner rails 36*a* and 36*b*. The pad members 40Aa and 40Ab are disposed at multiple locations along the longitudinal direction of the U-shaped heat-transfer tubes 17*a* and 17*b*. The pad members 40Aa and 40Ab may be disposed so as to be in contact with the respective tube bundle side plates 34*a* and 34*b*, or gaps may be provided between the pad members 40Aa, 40Ab and the respective tube bundle side plates 34*a*, 34*b*. By providing gaps between the pad members 40Aa, 40Ab and the tube bundle side plates 34*a*, 34*b*, not only the inner rails 36*a* and 36*b* is made to be more slidable but also the heater 4 may be deformed to thereby prevent reaction forces from being induced in the pad members 40Aa and 40Ab.

Among the plurality of pad members 40Aa and 40Ab, pad members 40Aaa and 40Aba closest to the steam heating headers 16*a* and 16*b* and pad members 40Aab and 40Abb closest to the curved tube portions 19*a* and 19*b* are disposed so as to satisfy the Expression 1.

According to the thus configured moisture separator/heater 1A, the pad members 40Aa and 40Ab restrict deformation (bending) of the tube bundle side plates 34*a* and 34*b*, which reduces the gaps created between the inner and outer rails when the heater 4 is lifted due to the difference in the amount of thermal deformation between the inner rails 36*a*, 36*b* and the outer rails 37*a*, 37*b* and a lifting force of the steam to be heated that flows through the main shell 2.

In this configuration, by disposing the pad members 40Aa and 40Ab so as to satisfy the Expression 1, the gaps between the inner and outer rails and reaction forces induced in the pad members 40Aa and 40Ab can be minimized. Furthermore, since the gaps between the inner and outer rails can be minimized, decrease in performance of the moisture separator/heater 1A resulting from leak paths between the inner and outer rails can be sufficiently reduced.

Therefore, in the moisture separator/heater 1A according to the present embodiment, the leak paths between the inner rails 36*a*, 36*b* and the outer rails 37*a*, 37*b* can be made sufficiently narrow irrespective of the length of the U-shaped heat-transfer tubes 17*a* and 17*b*.

It is further to be noted that the moisture separator/heater 1A according to the present embodiment was described with reference to a simplex moisture separator/heater, it may be configured as a duplex moisture separator/heater.

[Third Embodiment]

A third embodiment of the moisture separator/heater according to the present invention will be described hereunder with reference to FIG. 7.

Figure 7:
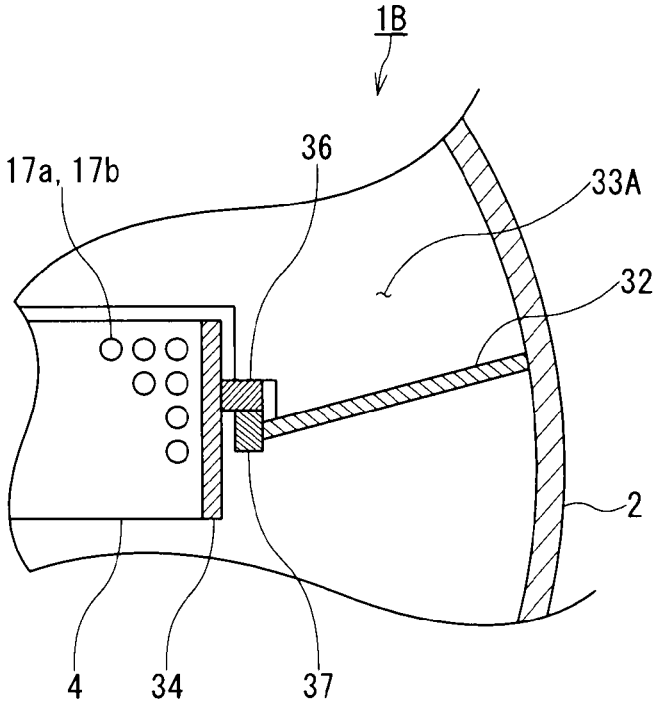
FIG. 7 is a transverse sectional view showing a schematic configuration of an essential portion of a moisture separator/heater according to a third embodiment of the present invention.

FIG. 7 is a transverse sectional view showing a schematic configuration of an essential portion of the moisture separator/heater according to the third embodiment of the present invention.

In the present embodiment, the components common to those in the first embodiment are added with the same reference numerals, and duplicated description will be omitted.

As shown in FIG. 7, inside the main shell 2 of a moisture separator/heater 1B according to the present embodiment, a plurality of heat-transfer tube supporting plates 33A (restricting members) are provided at fixed intervals along the longitudinal direction of the U-shaped heat-transfer tubes 17*a* and 17*b*.

The heat-transfer tube supporting plates 33A, which are restricting members, are disposed so as to sandwich tube bundle side plates 34 with outer rails 37 attached to channel partition plates 32 to thereby restrict the rounded-back deformation thereof. Specifically, the heat-transfer tube supporting plates 33A are disposed so as to sandwich inner rails 36 with the outer rails 37. The heat-transfer tube supporting plates 33A may be disposed so as to be in contact with the inner rails 36, or gaps are provided between the heat-transfer tube supporting plates 33A and the inner rails 36. Providing gaps between the heat-transfer tube supporting plates 33A and the inner rails 36 not only makes the inner rails 36 more slidable and allows the heater 4 to deform and prevents reaction forces from being induced in the heat-transfer tube supporting plates 33A.

Among the plurality of heat-transfer tube supporting plates 33A, heat-transfer tube supporting plates 33A closest to the steam heating headers 16*a* and 16*b* and heat-transfer tube supporting plates 33A closest to the curved tube portions 19*a* and 19*b* are disposed so as to satisfy the Expression 1.

According to the thus configured moisture separator/heater 1B, the heat-transfer tube supporting plates 33A restrict deformation (bending) of the inner rails 36, resulting in the reduction of the gaps created between the inner and outer rails when the heater 4 is lifted due to the difference in the amount of thermal deformation between the inner rails 36 and the outer rails 37 and a lifting force of the steam to be heated that flows through the main shell 2. In this configuration, by disposing the heat-transfer tube supporting plates 33A in such a way to satisfy the Expression 1, and the gaps between the inner and outer rails and reaction forces induced in the heat-transfer tube supporting plates 33A can be minimized. Furthermore, since the gaps between the inner and outer rails can be minimized, decrease in performance of the moisture separator/heater 1B resulting from leak paths between the inner and outer rails can be sufficiently reduced.

Therefore, according to the moisture separator/heater 1B of the present embodiment, the leak paths between the inner rails 36 and the outer rails 37 can be made sufficiently narrow irrespective of the length of the U-shaped heat-transfer tubes 17*a* and 17*b*.

It is to be noted that although the moisture separator/heater 1B according to the present embodiment was described hereinabove with reference to a simplex moisture separator/heater, it may be also configured as a duplex moisture separator/heater.

[Fourth Embodiment]

A fourth embodiment of the moisture separator/heater according to the present invention will be described with reference to FIG. 8.

Figure 8:
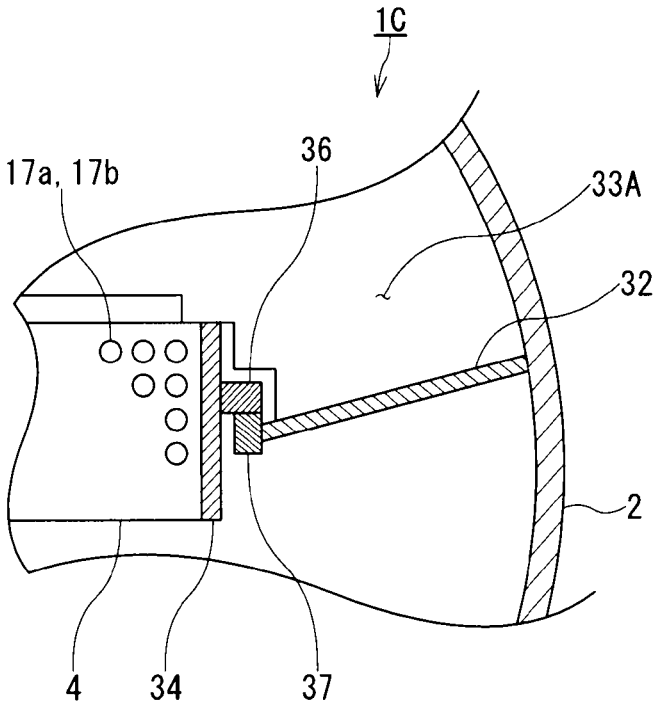
FIG. 8 is a transverse sectional view showing a schematic configuration of an essential portion of a moisture separator/heater according to a fourth embodiment of the present invention.
Figure 9:
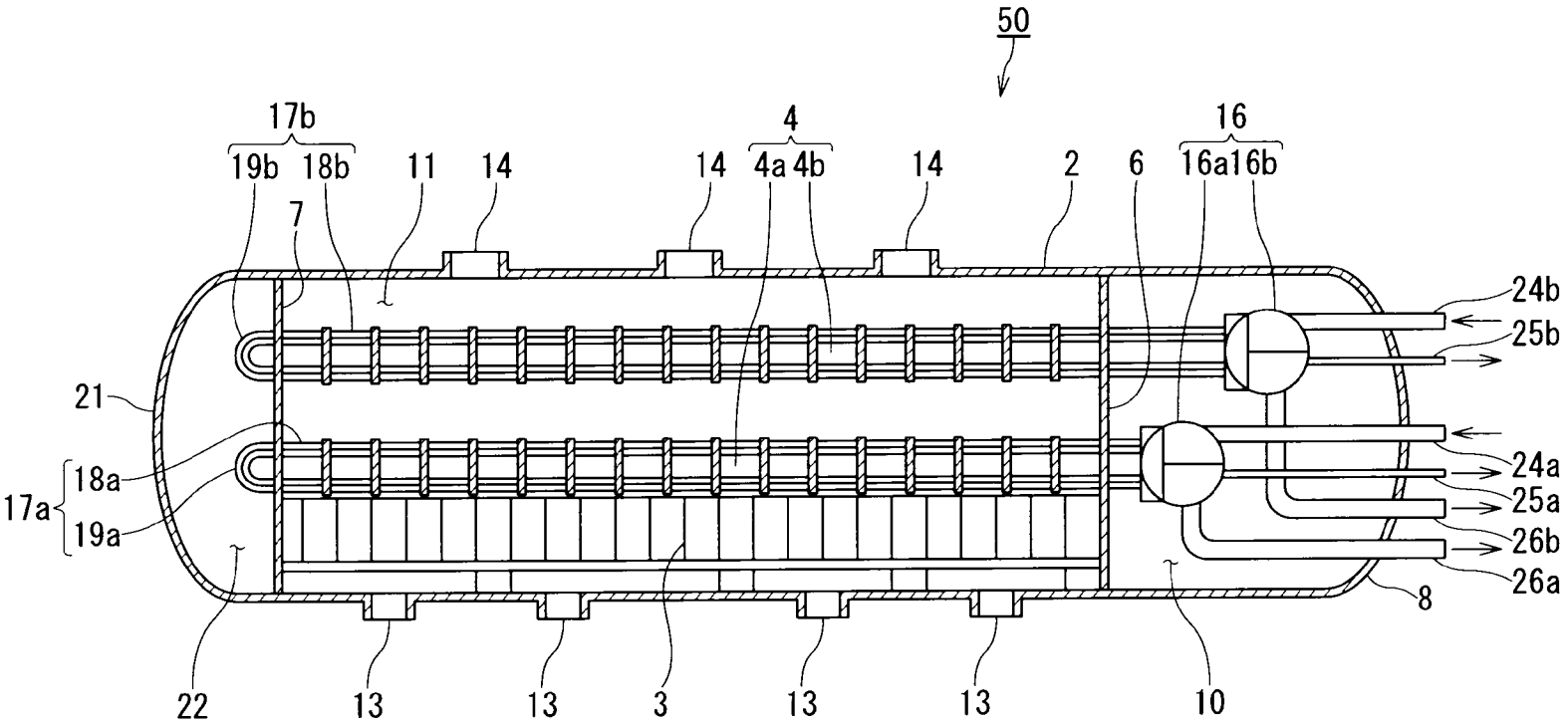
FIG. 9 is an axial schematic cross-sectional view showing a simplex moisture separator/heater of related art.
Figure 10:
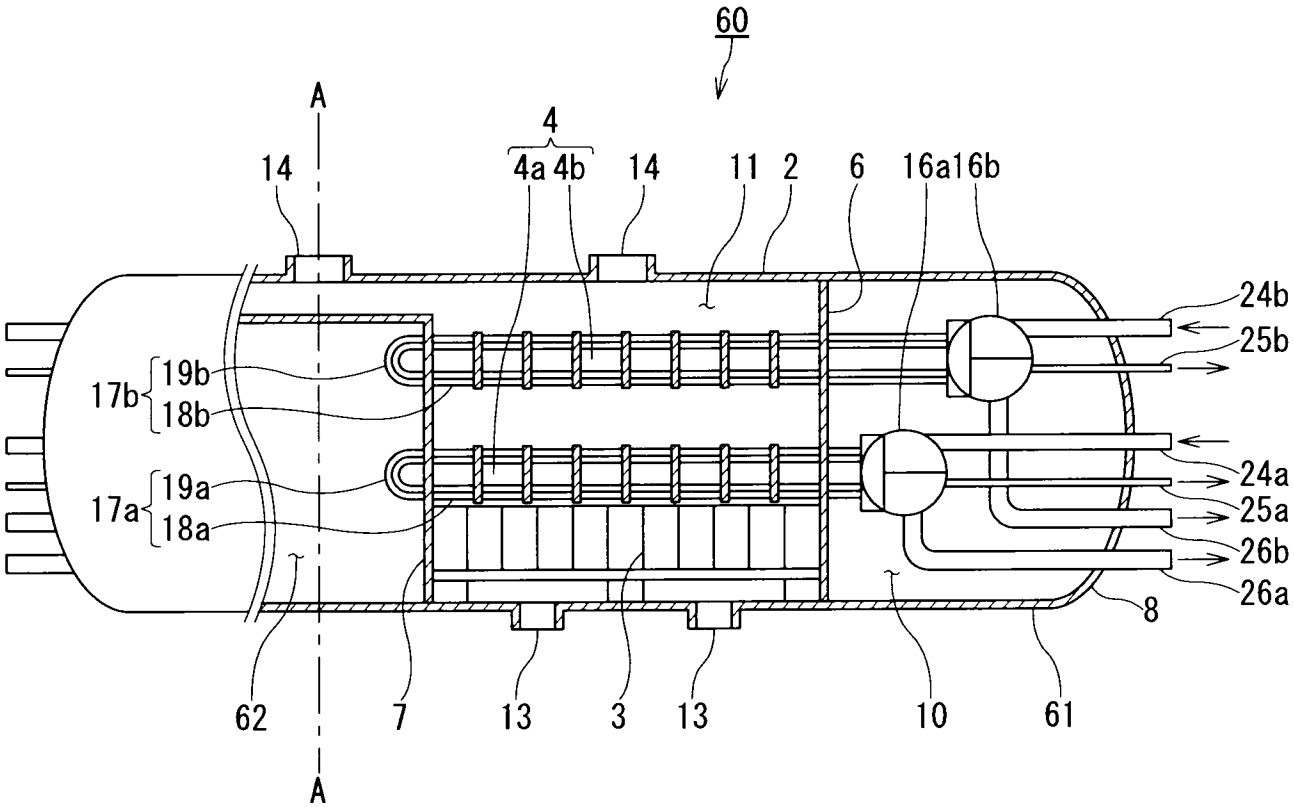
FIG. 10 is an axial schematic cross-sectional view showing a duplex moisture separator/heater of related art.
Figure 11:
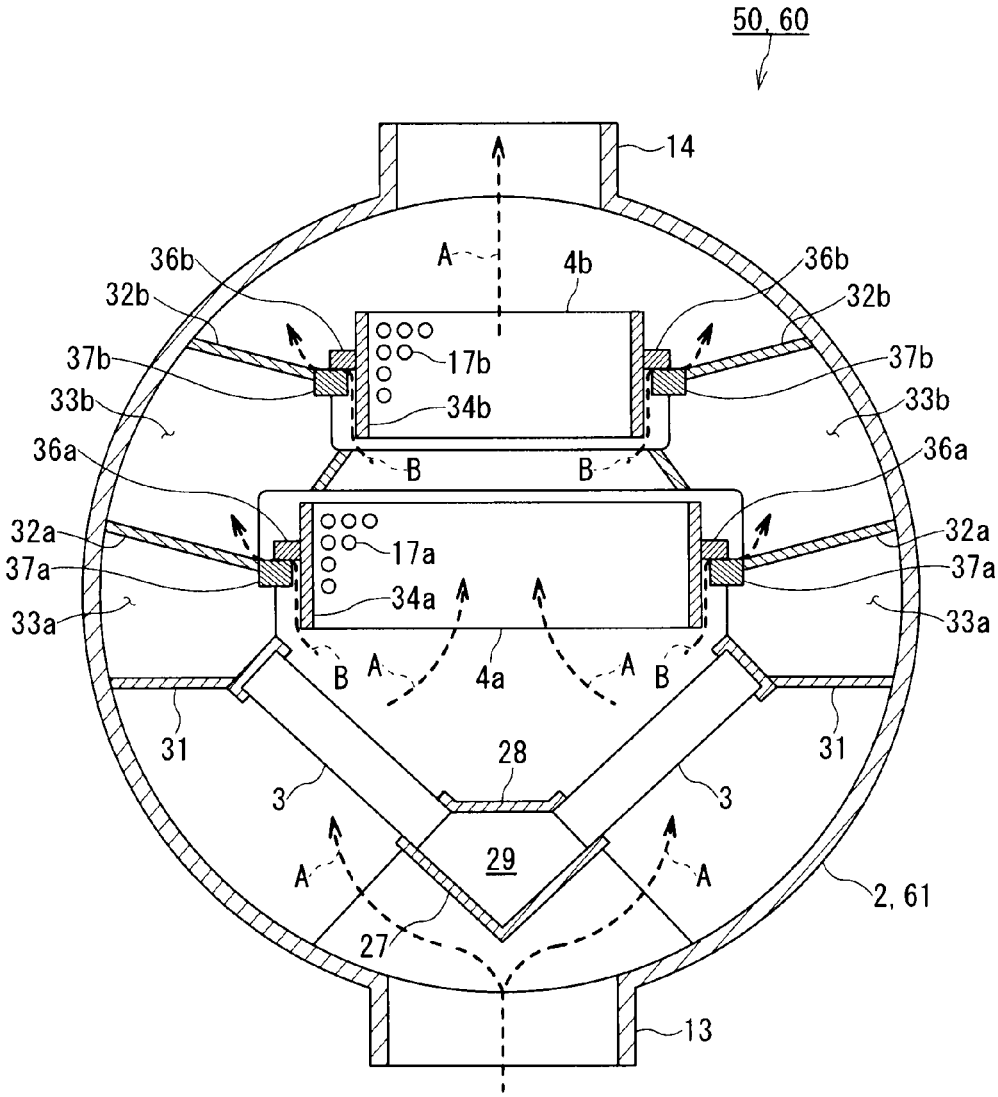
FIG. 11 is a cross-sectional view corresponding to FIG. 2 and showing a moisture separator/heater of related art shown in FIGS. 9 and 10.

FIG. 8 is a transverse sectional view showing a schematic configuration of an essential portion of the moisture separator/heater according to the fourth embodiment of the present invention.

In the present embodiment, the components common to those in the first embodiment are added with the same reference numerals, and duplicated description will be omitted.

With reference to FIG. 8, in the main shell 2 of a moisture separator/heater 1C according to the present embodiment, a plurality of heat-transfer tube supporting plates 33A (restricting members) are provided at fixed intervals along the longitudinal direction of the U-shaped heat-transfer tubes 17*a* and 17*b*.

The heat-transfer tube supporting plates 33A, which are restricting members, sandwich the tube bundle side plates 34 with the outer rails 37 attached to the channel partition plates 32 so as to restrict rounded-back deformation thereof. Specifically, the heat-transfer tube supporting plates 33A, which extend from upper ends of the tube bundle side plates 34, sandwich the upper half of the tube bundle side plates 34 and the inner rails 36 the with the outer rails 37. The heat-transfer tube supporting plates 33A may be disposed so as to abut against the respective tube bundle side plates 34, or gaps may be provided between the heat-transfer tube supporting plates 33A and the respective tube bundle side plates 34.

Providing gaps between the heat-transfer tube supporting plates 33A and the tube bundle side plates 34 not only makes the inner rails 36 more slidable but also allows the heater 4 to deform and prevents reaction forces from being induced in the heat-transfer tube supporting plates 33A.

The heat-transfer tube supporting plates 33A sandwiching the inner rails 36 may be disposed so as to abut against the inner rails 36, or gaps may be provided between the heat-transfer tube supporting plates 33A and the inner rails 36. Providing gaps between the heat-transfer tube supporting plates 33A and the inner rails 36 not only makes the inner rails 36 more slidable but also allows the heater 4 to deform and prevents reaction forces from being induced in the heat-transfer tube supporting plates 33A.

Among the plurality of heat-transfer tube supporting plates 33A, heat-transfer tube supporting plates 33A closest to the steam heating headers 16*a* and 16*b* and heat-transfer tube supporting plates 33A closest to the curved tube portions 19*a* and 19*b* are disposed so as to satisfy the Expression 1.

According to the thus configured moisture separator/heater 1C, the heat-transfer tube supporting plates 33A restrict deformation (bending) of the tube bundle side plates 34, which reduces the gaps formed between the inner and outer rails when the heater 4 is lifted due to the difference in the amount of thermal deformation between the inner rails 36 and the outer rails 37 and a lifting force of the steam to be heated that flows through the main shell 2. In this configuration, by disposing the heat-transfer tube supporting plates 33A so as to satisfy the Expression 1, the gaps between the inner and outer rails and reaction forces induced in the heat-transfer tube supporting plates 33A can be minimized. Furthermore, since the gaps between the inner and outer rails can be minimized, the decrease in performance of the moisture separator/heater 1C resulting from leak paths between the inner and outer rails can be sufficiently reduced.

Therefore, in the moisture separator/heater 1C according to the present embodiment, the leak paths between the inner rails 36 and the outer rails 37 can be made sufficiently narrow irrespective of the length of the U-shaped heat-transfer tubes 17*a* and 17*b*.

It is further to be noted that, in the above description, although the moisture separator/heater 1C according to the present embodiment was described with reference to a simplex moisture separator/heater, the present invention may also be configured as a duplex moisture separator/heater.

The invention claimed is:

1. A moisture separator/heater comprising:

a cylindrical main shell with both ends sealed with end plates;

a first partition plate disposed in the main shell on a side on which one of the end plates is present to define a header space between the first partition plate and the end plate;

a second partition plate disposed in the main shell so as to define a heating space between the second partition plate and the header-side partition plate;

a moisture separator disposed in a lower portion of the heating space and removing moisture in steam to be heated that flows in through a bottom of the main shell;

a heater disposed above the moisture separator in the main shell;

a channel partition plate, that partitions the interior of the heating space in such a way that the steam to be heated having flowed in through a low-temperature steam inlet provided at the bottom of the main shell, flows into the moisture separator, passes therethrough, and flows into the heater;

a plurality of heat-transfer supporting plates disposed in the heating space at intervals along a longitudinal direction of the heater;

a tube bundle side plate placed on the channel partition plate and extending along the longitudinal direction of the heater, the tube bundle side plate supporting the heater; and a plurality of restricting members disposed in the heating space, wherein the heater includes a heater header disposed in the header space and a U-shaped heat-transfer tube connected to the heater header, the U-shaped heat-transfer tube is composed of a straight tube portion disposed in the heating space and heating the steam to be heated that has passed through the moisture separator and a curved tube portion disposed outside the heating space, the tube bundle side plate has an inner rail attached thereto, the channel partition plate has an outer rail on which the inner rail is placed in a manner slidable along a longitudinal direction of the U-shaped heat-transfer tube, and the restricting members sandwich the tube bundle side plate with the outer rail to restrict rounded-back deformation thereof and are disposed so as to satisfy an expression of $$0.2 \leq L1/L,\ L2/L \leq 0.4$$

where L represents a total length of the straight tube portion, L1 represents a distance from one of the restricting members that is closest to the heater header to an end of the straight tube portion on the side where the heater header is present, and L2 represents a distance from one of the restricting members that is closest to the curved tube portion to an end of the straight tube portion on the side where the curved tube portion is present.

2. The moisture separator/heater according to claim 1, wherein the restricting members are composed of pad members attached to the channel partition plate and sandwich the inner rail with the outer rail.

3. The moisture separator/heater according to claim 2, wherein the inner rail and the restricting members are disposed with a gap therebetween.

4. The moisture separator/heater according to claim 1, wherein the restricting members are composed of pad members attached to the channel partition plate so as to extend to an upper portion of the tube bundle side plate, and sandwich the tube bundle side plate and the inner rail with the outer rail.

5. The moisture separator/heater according to claim 4, wherein the upper portion of the tube bundle side plate and the restricting members are disposed with a gap therebetween.

6. The moisture separator/heater according to claim 1, wherein the restricting members are composed of the heat-transfer supporting plates configured so as to sandwich the inner rail with the outer rail.

7. The moisture separator/heater according to claim 6, wherein the inner rail and the restricting members are disposed with a gap therebetween.

8. The moisture separator/heater according to claim 1, wherein the restricting members are the heat-transfer supporting plates configured so as to extend to an upper portion of the tube bundle side plate and sandwich the tube bundle side plate and the inner rail with the outer rail.

9. The moisture separator/heater according to claim 8, wherein the upper portion of the tube bundle side plate and the restricting members are disposed with a gap therebetween.

* * * * *